US008567647B2

(12) United States Patent
Naesje et al.

(10) Patent No.: US 8,567,647 B2
(45) Date of Patent: Oct. 29, 2013

(54) MULTIFUNCTIONAL SEAL DEVICE FOR A VALVE FOR A DRINKING RECEPTACLE

(75) Inventors: Kjetil Naesje, Sandnes (NO); Kyrre Delin Fredriksen, Stavanger (NO)

(73) Assignee: SmartSeal AS (NO)

( * ) Notice: Subject to any disclaimer, the term of this patent is extended or adjusted under 35 U.S.C. 154(b) by 920 days.

(21) Appl. No.: 12/374,133

(22) PCT Filed: Jun. 29, 2007

(86) PCT No.: PCT/NO2007/000244
§ 371 (c)(1),
(2), (4) Date: Jun. 30, 2009

(87) PCT Pub. No.: WO2008/016307
PCT Pub. Date: Feb. 7, 2008

(65) Prior Publication Data

US 2009/0302071 A1 Dec. 10, 2009

(30) Foreign Application Priority Data

Jul. 19, 2006 (NO) ..... 20063361

(51) Int. Cl.
*B65D 47/04* (2006.01)

(52) U.S. Cl.
USPC ..... 222/525; 222/559

(58) Field of Classification Search
USPC ..... 222/525, 523, 524, 554, 559, 563, 566, 222/527–529, 531, 532, 537
See application file for complete search history.

(56) References Cited

U.S. PATENT DOCUMENTS

| | | | | | |
|---|---|---|---|---|---|
| 2,054,881 | A | * | 9/1936 | Saunders | 222/181.2 |
| 2,775,369 | A | * | 12/1956 | Waite | 222/92 |
| 2,908,446 | A | * | 10/1959 | Strouse | 239/573 |
| 2,992,761 | A | * | 7/1961 | Sommers, Sr. | 222/479 |
| 3,133,310 | A | * | 5/1964 | Yorker et al. | 401/262 |
| 3,157,323 | A | * | 11/1964 | Kitterman | 222/520 |

(Continued)

FOREIGN PATENT DOCUMENTS

| | | |
|---|---|---|
| DE | 9204076 U1 | 7/1993 |
| DE | 100 28 527 A1 | 12/2001 |

(Continued)

OTHER PUBLICATIONS

International Search Report for parent application PCT/NO2007/000244, having a mailing date of Oct. 23, 2007.

*Primary Examiner* — Paul R Durand
*Assistant Examiner* — Donnell Long
(74) *Attorney, Agent, or Firm* — Andrus, Sceales, Starke & Sawall, LLP

(57) ABSTRACT

A multifunctional sealing device for a valve structured for opening of a discharge conduit by virtue of upstream-directed movement of a sealing body relative to the discharge direction. The distinctive characteristic of the invention is that the sealing body is of a radially flexible arrangement; wherein the discharge conduit is provided with at least one storage seal seat for sealing reception of the sealing body when the valve is in a storage mode, and also at least one utility seal seat for sealing reception of the sealing body when the valve is in a closed utility mode; wherein the at least one utility seal seat is provided upstream of the at least one storage seal seat; and wherein both the storage seal seat and the utility seal seat are structured for sealing against the sealing body during downstream-directed movement of the sealing body.

11 Claims, 4 Drawing Sheets

(56) References Cited

U.S. PATENT DOCUMENTS

Figure 1A:
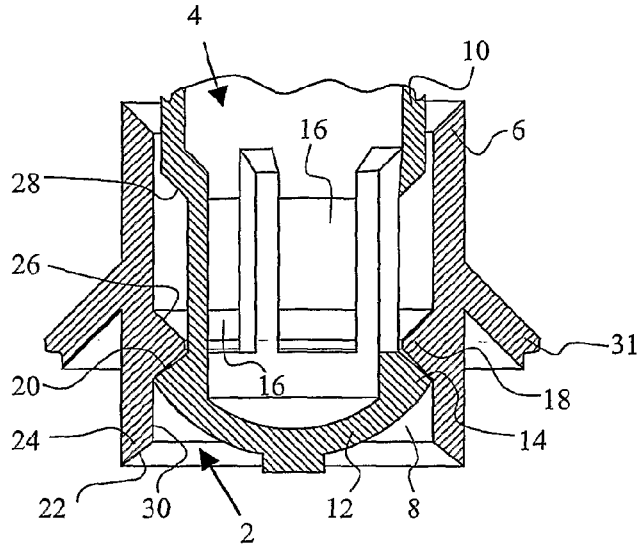

| | | | | | |
|---|---|---|---|---|---|
| 3,245,587 | A * | 4/1966 | Brown | 222/182 |
| 3,268,125 | A * | 8/1966 | Waldrum | 222/482 |
| 3,300,099 | A * | 1/1967 | Marona | 222/207 |
| 3,352,464 | A * | 11/1967 | Frangos | 222/402.2 |
| 3,388,211 | A * | 6/1968 | Nichols et al. | 174/152 R |
| 3,842,728 | A | 10/1974 | Elineau | |
| 4,480,769 | A * | 11/1984 | Tellini | 222/519 |
| 4,483,465 | A * | 11/1984 | Lawrence | 222/83.5 |
| 4,742,851 | A * | 5/1988 | Lundblade | 137/614.12 |
| 4,848,600 | A * | 7/1989 | Dark | 222/498 |
| 5,337,931 | A | 8/1994 | Kitterman | |
| 5,494,196 | A * | 2/1996 | Tyner | 222/147 |
| 6,257,453 | B1 * | 7/2001 | Graham | 222/153.06 |
| 6,257,463 | B1 | 7/2001 | De Polo | |
| 6,763,980 | B2 * | 7/2004 | Godwin et al. | 222/553 |
| 6,871,764 | B2 | 3/2005 | Stoneberg et al. | |
| 7,537,133 | B2 * | 5/2009 | Naesje | 220/714 |
| 2003/0168474 | A1 * | 9/2003 | Widgery | 222/183 |
| 2004/0144792 | A1 | 7/2004 | Naesje | |
| 2005/0017030 | A1 | 1/2005 | Patz | |

FOREIGN PATENT DOCUMENTS

| | | | |
|---|---|---|---|
| EP | 1 065 150 | A1 | 1/2001 |
| EP | 1 065 150 | B1 | 9/2004 |
| EP | 1 404 587 | B1 | 3/2006 |
| EP | 1 404 587 | B9 | 3/2006 |
| FR | 2 174 751 | A1 | 10/1973 |
| FR | 2 496 598 | A3 | 6/1982 |
| FR | 2 731 680 | A1 | 9/1996 |
| JP | 6-321247 | A | 11/1994 |
| NO | 316506 | B1 | 2/2004 |
| NO | 320924 | B1 | 2/2006 |
| NO | 321708 | B1 | 6/2006 |
| NO | 323158 | B1 | 1/2007 |
| WO | 92/03372 | A1 | 3/1992 |
| WO | 98/38103 | A1 | 9/1998 |
| WO | 02/34637 | A1 | 5/2002 |
| WO | 02/098757 | A1 | 12/2002 |
| WO | 2004/009455 | A2 | 1/2004 |
| WO | 2004/009455 | A3 | 1/2004 |
| WO | 2004/039690 | A1 | 5/2004 |
| WO | 2005/026012 | A1 | 3/2005 |
| WO | 2005/035379 | A2 | 4/2005 |
| WO | 2006/028378 | A1 | 3/2006 |

* cited by examiner

MULTIFUNCTIONAL SEAL DEVICE FOR A VALVE FOR A DRINKING RECEPTACLE

CROSS-REFERENCE TO RELATED APPLICATIONS

This application is the U.S. national stage application of International Application No. PCT/NO2007/000244, filed Jun. 29, 2007, which International application was published on Feb. 7, 2008, as International Publication No. WO 2008/016307 A1 in the English language, which application is incorporated herein by reference. The International application claims priority of Norwegian Patent Application No. 20063361, filed Jul. 19, 2006, which application is incorporated herein by reference.

AREA OF THE INVENTION

The present invention concerns a multifunctional sealing device for a valve for a drinking receptacle. The present sealing device is structured to be able to provide good sealing of the valve both when it is in a storage mode and in a closed utility mode, and without necessarily having to deactivate or remove a stopping/closing device in order to rearrange the valve from the storage mode to the utility mode. As such, the utility mode comprises a closed utility mode, in which the valve is closed, and an open utility mode, in which the valve is open.

In the storage mode, the sealing device is structured to function as a good seal in connection with filling, packing, transport and storage of a beverage in the drinking receptacle, hereinafter termed a storage seal. The sealing device is particularly well-suited for sealing in connection with aseptic treatment of the valve and any associated components, such as a valve cover and/or an enclosure for the valve. In connection with aseptic treatment, the storage seal should be of a gas-tight arrangement.

In the closed utility mode, the sealing device is also structured to function as a good seal in connection with consumption of the beverage in the drinking receptacle, hereinafter termed a utility seal. Upon consumption, the valve is normally opened and closed repeatedly, and the sealing device is therefore structured to be able to function satisfactorily also in context of this type of application.

Moreover, the sealing device may be used in connection with a pressurized or non-pressurized beverage in the receptacle. The drinking receptacle may, for example, be a bottle, soda bottle, feeding bottle, carton, bag, pot, tube, paper cup or plastic cup. Preferably, the sealing device and the valve are structured for releasable connection to the drinking receptacle, for example via a suitable enclosure. Opening and closing of the valve may be carried out manually, but valve-activating auxiliary mechanisms known per se may also be used for this purpose.

BACKGROUND OF THE INVENTION

The invention springs out of a need in the industry for providing a valve sealing device that is multifunctional and simple to produce, and which is safer and more versatile than known valve sealing devices for drinking receptacles. This need is particularly aimed at providing a sealing device exhibiting a safer sealing function when the valve is in the storage mode.

There is also a need for providing a sealing device that prevents unintentional opening of the valve for undesirable invasion of an aseptic solution, which otherwise is used for bactericidal treatment of the valve and associated components. In this connection, and for hygienic reasons, the downstream side of the valve may be sealingly connected to, and is enclosed by, a protective cover or similar. During the aseptic treatment process, the valve and the protective cover is normally immersed into a heated aseptic solution containing a bactericide. An air cushion, which is located between the protective cover and the valve, will thus be heated so as to increase the pressure in the air cushion. If the sealing device of the valve is inadequately gas-tight, the increase in air pressure will ensure that air leaks out of the air cushion via the valve, which reduces the amount of air in the air cushion. Subsequently, when the aseptic treatment is ended and the reduced amount of air in the air cushion is cooled, an underpressure will form in the air cushion. Insofar as the sealing device of the valve is inadequately gas-tight, this underpressure may cause air to be sucked unintentionally back and into the protective cover via the valve. This air flow through the valve may then entrain liquid residues from the aseptic solution and onwards into the protective cover where the liquid residues may be deposited as droplets and/or solid deposits on the cover and the valve. Such droplets and/or solid deposits are visually unappealing and may inflict foul taste in the beverage during consumption thereof. Such an effect is therefore undesirable.

Accordingly, there is a need for providing a sealing device that functions satisfactorily under different conditions to which the valve is exposed during its operating lifetime.

PRIOR ART AND DISADVANTAGES THEREOF

U.S. Pat. No. 6,257,463, which corresponds to EP 1.065.150, concerns an aseptic connection device for a drinking receptacle. Among other things, the connection device comprises a manually operated valve based on an axial push/pull principle. The valve is connected to a discharge opening provided in an end wall of a threaded cap for a drinking receptacle.

The valve according to U.S. Pat. No. 6,257,463 comprises a discharge pipe provided at the downstream side of the cap's end wall, the upstream thereof being provided with a cylindrical sealing plug. During closing of the valve, the sealing plug is pushed axially into said discharge opening for sealing engagement with the end wall defining the discharge opening. During opening of the valve, the sealing plug is pulled axially out of the discharge opening for disengagement therefrom. These axial movements are assisted by tubular guides disposed axially and concentrically about the discharge pipe. Furthermore, the discharge pipe is provided with pipe wall openings provided immediately downstream of the sealing plug, whereby discharge will take place through the discharge pipe and out via a drinking spout.

Thereby, the valve construction according to U.S. Pat. No. 6,257,463 only has one seal seat for sealing reception of the sealing plug, the seal seat of which must be used both when the valve is in the storage mode and in the closed utility mode. As a consequence of this valve construction, and as a distinction from the present multifunctional sealing device, this valve will also open in response to downstream-directed movement of the sealing plug and the discharge pipe relative to the discharge direction of the valve, whereas closing of the valve will take place in response to upstream-directed movement of said components. Among other things, such a valve construction is encumbered with the disadvantage that an overpressure in the drinking receptacle may push the sealing plug in a downstream direction and out of its sealing seat within said discharge opening, whereby the valve may open unintentionally.

A similar valve construction is also shown in U.S. Pat. No. 6,871,764 corresponding to international publication WO 2004/009455.

OBJECT OF THE INVENTION

The object of the invention is to remedy or avoid disadvantages of known valve technology in the present area.

HOW TO ACHIEVE THE OBJECT

The object is achieved by means of features disclosed in the following description and in the subsequent claims.

According to the invention, a multifunctional sealing device for a valve for a drinking receptacle is provided, for example a drinking receptacle in the form of a bottle, soda bottle, feeding bottle, carton, bag, pot, tube, paper cup or plastic cup.

The present valve is connected to a discharge conduit structured for connection to the drinking receptacle, the valve comprising:

- a moveable manoeuvre body for activation of the valve; and
- a sealing body connected to the manoeuvre body for opening and closing of the discharge conduit; and
- in which the valve is structured for opening of the discharge conduit by virtue of upstream-directed movement of the sealing body relative to the discharge direction of the valve. The distinctive characteristic of the invention is that the sealing body is of a radially flexible arrangement;
- wherein the discharge conduit is provided with at least one storage seal seat for sealing reception of the sealing body when the valve is in a storage mode, and also at least one utility seal seat for sealing reception of the sealing body when the valve is in a closed utility mode;
- wherein the at least one utility seal seat is located upstream of the at least one storage seal seat; and
- wherein both the storage seal seat and the utility seal seat are structured for sealing against the sealing body during downstream-directed movement of the sealing body.

According to a first aspect of the multifunctional sealing device, the discharge conduit is defined by a non-moveable and tubular body, whilst the manoeuvre body comprises an axially movable valve stem located in the tubular body;

- wherein the tubular body, along the inner periphery thereof, is provided with a ring-shaped seal bulb extending into the body and including an upstream-directed storage seal seat;
- wherein the tubular body, in a region upstream of the seal bulb, also is provided with a utility seal seat in the form of a upstream-directed, ring-shaped end seat;
- wherein the valve stem is provided with a flexible and ring-shaped seal collar extending outwardly towards the tubular body and being located in a region upstream of the seal bulb, which allows for sealing against said storage seal seat and also said utility seal seat; and
- wherein the seal collar is structured in a manner allowing it to appear in a radially expanded position for sealing against said end seat when the valve is in the closed utility mode.

According to this first aspect of the sealing device, the tubular body may also include an internal, ring-shaped seal portion located in a longitudinal region between the end seat and the seal bulb; wherein at least a section of the seal portion is structured for slide-sealing against the seal collar.

The internal seal portion may have any length and/or shape suitable for the particular purpose. The seal portion and/or the seal collar may also be of a friction-promoting arrangement in order to counteract axial movement of the seal collar in the seal portion.

Thus, the internal seal portion may be of a cylindrical shape; wherein the seal collar, when in its radially expanded position, is arranged to have a respective equal or larger diameter than the diameter of the cylindrical seal portion (30). Thereby, the seal collar will be radially unaltered or radially compressed, respectively, when located in the cylindrical seal portion, which thus functions both as said storage seal seat and said utility seal seat. Depending on the seal collar's potential degree of compression in the seal portion, this embodiment variant will seek to counteract the seal collar's axial movements in both directions.

Alternatively, the internal seal portion may be of a shape tapering in the upstream direction; wherein the seal collar, when in its radially expanded position, is arranged to have a larger transverse dimension than the smallest transverse dimension of the upstream tapering seal portion. Thereby, the seal collar will be radially compressed at least in an upstream section of the seal portion, which thus functions as said storage seal seat. This embodiment variant is well-suited should an underpressure exist or arise in the drinking receptacle when the valve is in the storage mode, i.e. before the beverage in the receptacle is consumed. Although undesirable, such an underpressure will seek to move the seal collar in the upstream direction so as to open the valve. The seal portion's tapering shape in the upstream direction is suitable for counteracting such an undesirable opening of the valve, and preferably for rendering the valve gas-tight when positioned in the storage mode. Such a valve construction will require a relatively large activation force to rearrange the valve from the storage mode to the utility mode.

As a further alternative, the internal seal portion may be of a shape tapering in the downstream direction; wherein the seal collar, when in its radially expanded position, is arranged to have a larger transverse dimension than the largest transverse dimension of the downstream tapering seal portion. Thereby, the seal collar will be radially compressed at least in a downstream section of the seal portion, which thus functions as said utility seal seat. This embodiment variant is well-suited should an overpressure exist in the drinking receptacle when the valve is in the storage mode or in the closed utility mode. Such a condition will exist, for example, if the drinking receptacle contains a pressurized beverage, such as a carbonated drink. Said overpressure will seek to move the seal collar in the downstream direction so as to close the valve. The seal portion's tapering shape in the downstream direction is suitable for improving the sealing integrity of the valve, and preferably for rendering it gas-tight.

Said seal bulb may also include a downstream-directed, ring-shaped stop seat;

- wherein said valve stem, in a region located downstream of the seal bulb, is provided with an external stop device; and
- wherein the stop device and the stop seat are structured for motion-limiting contact with one another during upstream-directed axial movement of the valve stem. The stop device is to limit the upstream-directed axial movement of the valve stem to a position in which the valve opens satisfactorily. If the valve stem is massive, the external stop device of the valve stem must be arranged in a by-passable flow manner. Such a stop device may, for example, be comprised of a peripheral-partial stop collar or one or more peripheral-partial stop segments located on the outside of the valve stem.

In a preferred embodiment, the valve stem is comprised of a discharge pipe, the upstream end of which is closed; and wherein the discharge pipe is provided with at least one pipe wall opening located immediately downstream of the seal collar. Thereby, discharge will take place through said pipe wall opening and the discharge pipe.

A valve construction similar to the latter embodiment, and which employs a partition and a discharge pipe provided with an upstream-opening valve head, is described both in NO 320924, which corresponds to WO 2004/039690; and in NO 321708, which corresponds to WO 2006/028378. However, none of these publications discloses a multifunctional sealing device as disclosed for the present invention.

According to a second aspect of the multifunctional sealing device, said manoeuvre body comprises an axially moveable and tubular body, the body of which includes a ring-shaped, flexible seal portion located at a downstream discharge portion of the body, the tubular body defining said discharge conduit;

- wherein a non-moveable valve head is located immediately downstream of the flexible seal portion for sealing reception thereof;
- wherein the valve head includes an external storage seal portion located in a longitudinal region of the valve head;
- wherein the valve head also includes an external utility seal portion located upstream of said storage seal portion;
- wherein the transverse dimension of the utility seal portion is smaller than the transverse dimension of the storage seal portion; and
- wherein the flexible seal portion of the tubular body is structured in a manner allowing it to appear in a radially expanded position for sealing against the external storage seal portion of the valve head when the valve is in the storage mode.

A valve construction similar to the embodiment according to second aspect of the multifunctional sealing device is described in NO 20034132, which corresponds to international publication WO 2005/026012. Also this publication does not disclose a multifunctional sealing device as disclosed for the present invention.

According to this second aspect of the present sealing device, at least one of the external storage seal portion of the valve head and the seal portion of the tubular body may be of a friction-promoting arrangement.

Moreover, the valve head may also include an external, upstream-directed stop seat located downstream of said storage seal portion.

In addition, the utility seal portion of the valve head may be of a shape tapering in the upstream direction for progressively sealing reception of the flexible and axially moveable seal portion of the tubular body when the valve is in the closed utility mode.

Yet further, the non-moveable valve head may be attached in a by-passable flow manner to a surrounding support structure arranged for connection to said drinking receptacle. Such a support structure may be comprised of an enclosure, for example a screw cap for a bottle, such as the one disclosed in the abovementioned patent application NO 20034132, which corresponds to WO 2005/026012.

In all of the preceding embodiments, the sealing body of the valve may be of a radially flexible arrangement by virtue of the sealing body being comprised of an elastic material, which preferably is a suitable plastics material.

In general, said manoeuvre body may also comprise a stiffening activation element, for example one or more stays, trans-mission arms, spindles or similar, connected to the sealing body of the valve. Said valve stem, for example embodied as a discharge pipe, will normally have a stiffening shape and may thus function as such an activation element.

The activation element may be structured for valve-activating, axial movement of the sealing body. The activation element may also be structured for axial movement of the sealing body via peripheral-rotational movement of the activation element, for example by employing one or more threaded connections between the activation element and a support structure therefore. Alternatively, the activation element may be structured for axial movement of the sealing body via linear-axial movement of the activation element, i.e. by employing an axial push/pull principle. As an example of this principle, the connection device according to U.S. Pat. No. 6,257,463 discloses a linear-axially moveable activation element for opening and closing of a valve.

Thus, the activation element may be structured for axial movement of the sealing body through manual operation of the activation element; cf. the manually operated, linear-axially moveable activation element according to U.S. Pat. No. 6,257,463. Alternatively, the activation element may be structured for axial movement of the sealing body by employing an auxiliary mechanism for this purpose.

As a preferred example of such an auxiliary mechanism, the manoeuvre body of the present valve may also comprise a flexible and pressure-responsive membrane connected to the stiffening activation element for operation thereof;

- wherein the membrane is pressure-balanced against the ambient pressure of said drinking receptacle via an adjacent suction chamber; and
- wherein the membrane is structured to be able to supply an upstream-directed and valve-opening axial movement to the manoeuvre body when said suction chamber is supplied an underpressure being less than said ambient pressure.

Various embodiment variants of such a membrane-based and underpressure-activated manoeuvre body are known from several patent publications, including:

- NO 316506, the patent of which corresponds to WO 2002/098757 and EP 1.404.587;
- NO 320924, the patent of which corresponds to WO 2004/039690 (mentioned above);
- NO 321708, the patent of which corresponds to WO 2006/028378 (mentioned above); and
- NO 20034132, the patent application of which corresponds to WO 2005/026012 (mentioned above).

However, none of these patent publications disclose a multifunctional sealing device as disclosed for the present invention.

In general, the present valve may be connected to an opening in a wall portion of said drinking receptacle, and preferably releasably connected to said wall portion opening. Alternatively, the valve may be connected to an opening in a separate wall portion, for example a plate or similar, being arranged for connection to the drinking receptacle. As a further alternative, the valve may be located in an enclosure arranged for connection to an opening in the drinking receptacle.

All of the abovementioned Norwegian patent publications disclose various examples of how a valve for a drinking receptacle may be connected thereto, but indeed not a valve that includes a multifunctional sealing device according to present invention.

SHORT DESCRIPTION OF THE DRAWINGS

Figure 2A:
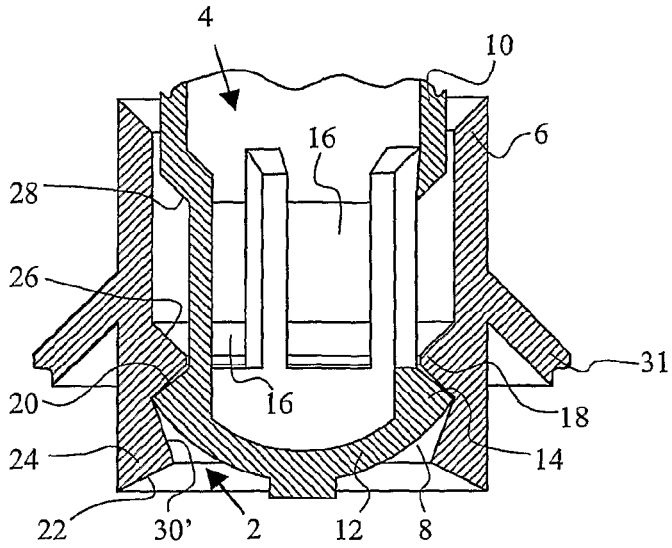
Figure 2B:
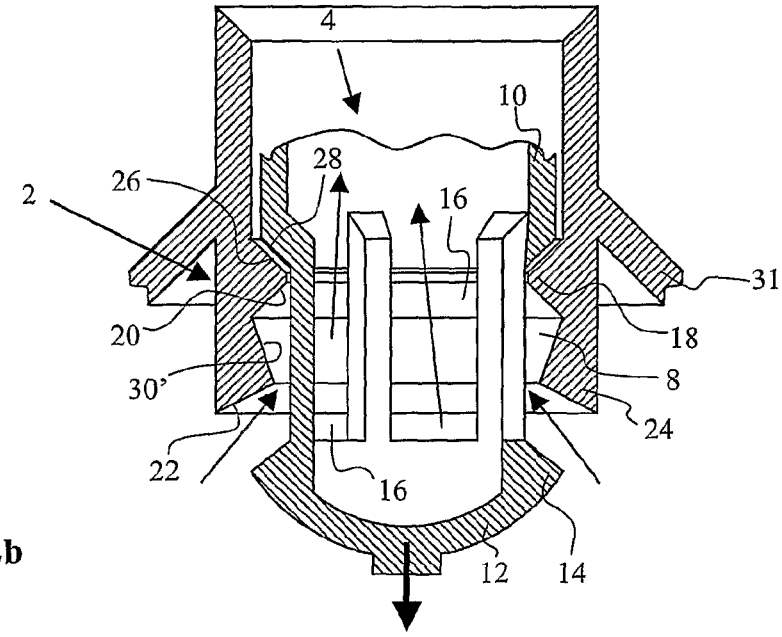
Figure 2C:
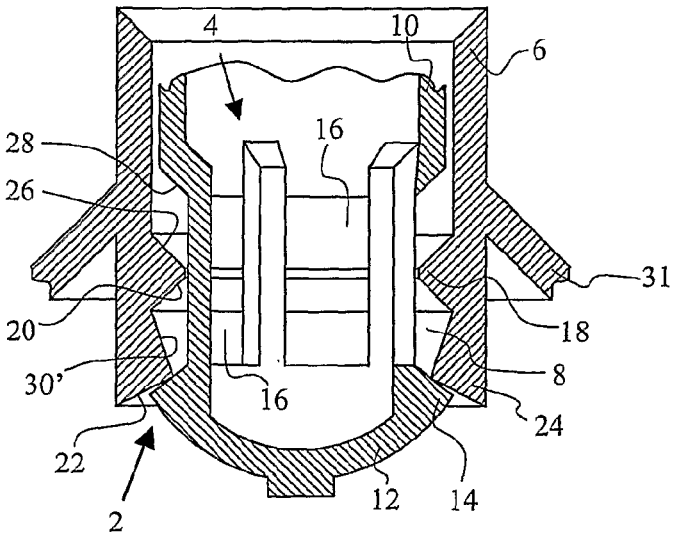
Figure 3A:
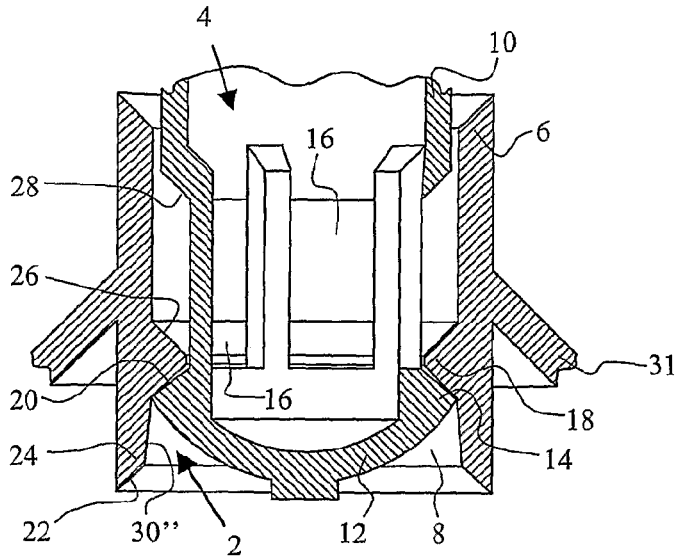
Figure 3B:
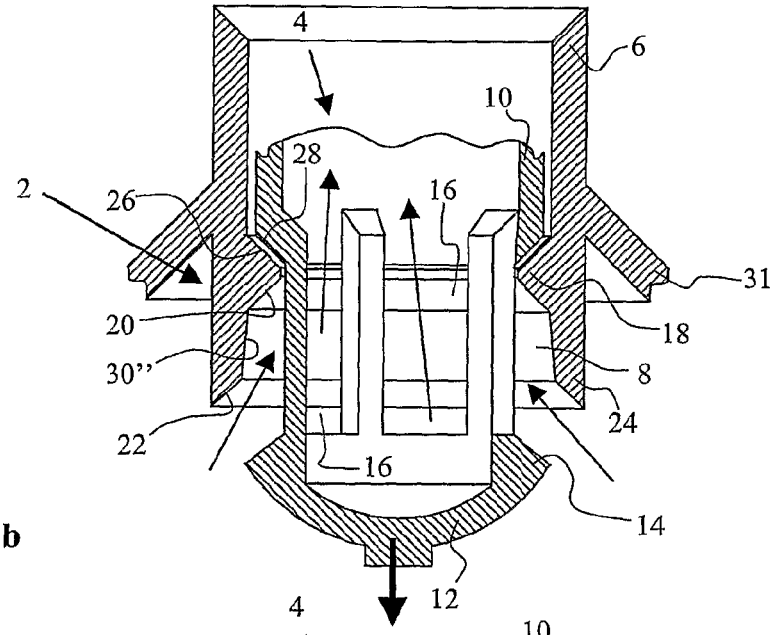
Figure 3C:
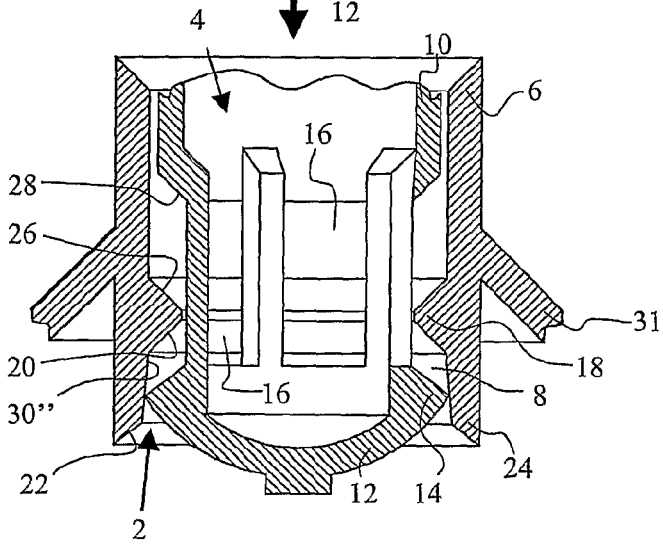
Figure 4A:
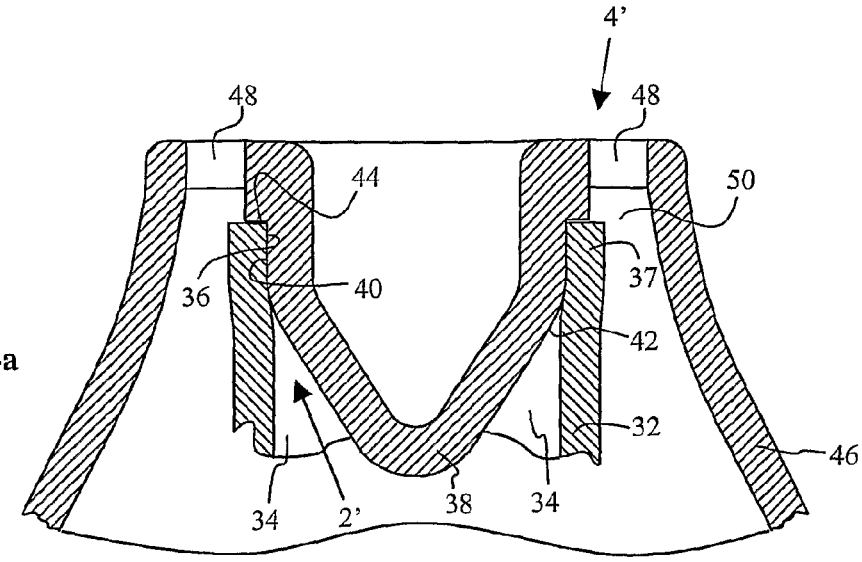
Figure 4B:
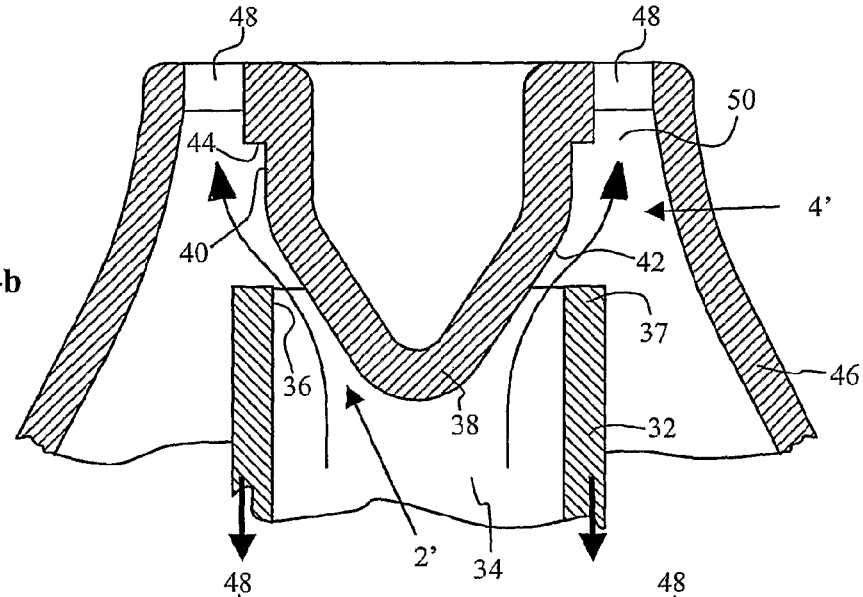
Figure 4C:
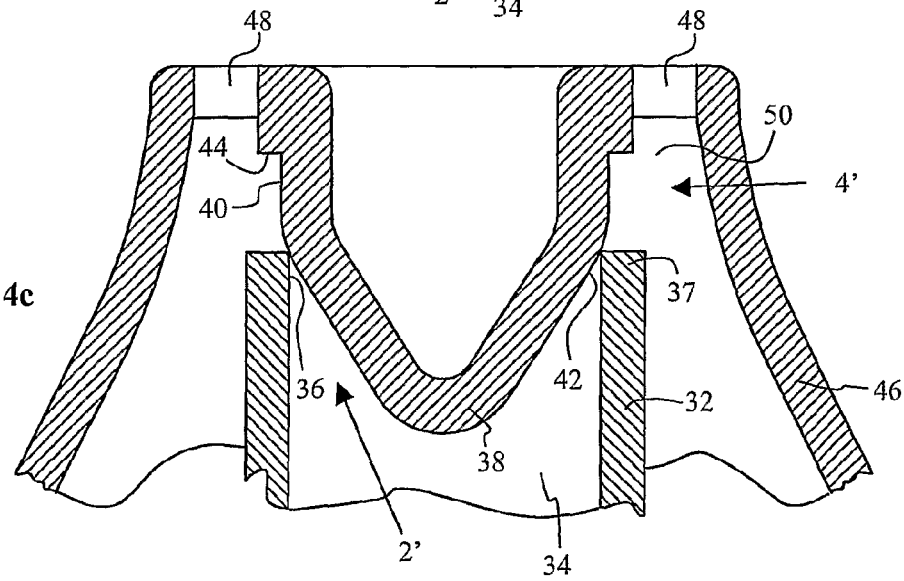

In the following, four different examples of embodiments of the invention will be shown, in which:

FIGS. 1*a*-3*c* show a longitudinal section through a valve provided with three different variants of a multifunctional sealing device formed in accordance with said first aspect of the device, the terms "a", "b" and "c" of the figure references depicting the valve in the storage mode, in the open utility mode, and in the closed utility mode, respectively; whereas FIGS. 4*a*-4*c* show a longitudinal section through a valve provided with one variant of a multifunctional sealing device formed in accordance with said second aspect of the device, the terms "a", "b" and "c" of the figure references depicting the valve in the storage mode, in the open utility mode, and in the closed utility mode, respectively.

The figures are schematic and may be somewhat distorted with respect to relative dimensions and position of components relative to one another. In general, similar or corresponding details of the figures will be given the same or similar reference numerals in the following.

EXAMPLES OF EMBODIMENTS OF THE INVENTION

FIGS. 1*a*-1*c*, 2*a*-2*c* and 3*a*-3*c* show three variants of a multifunctional sealing device formed in accordance with said first aspect of the invention.

Figure 1B:
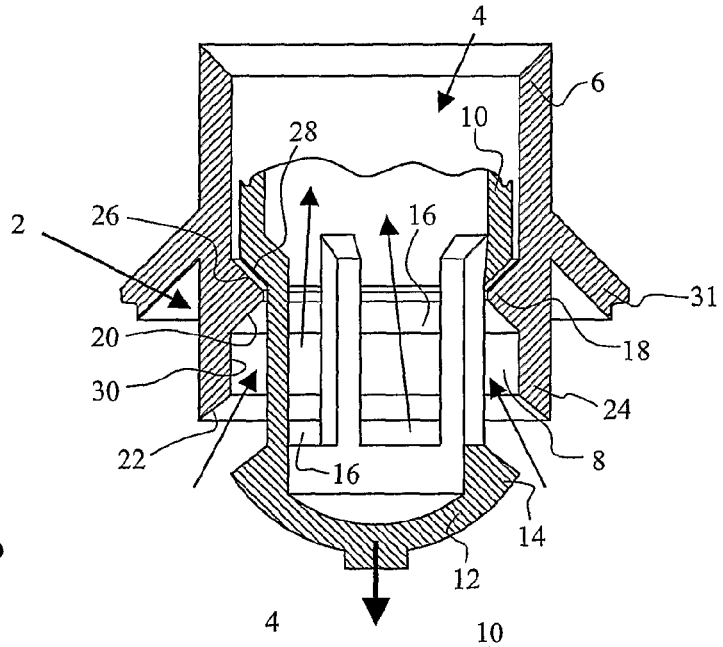
Figure 1C:
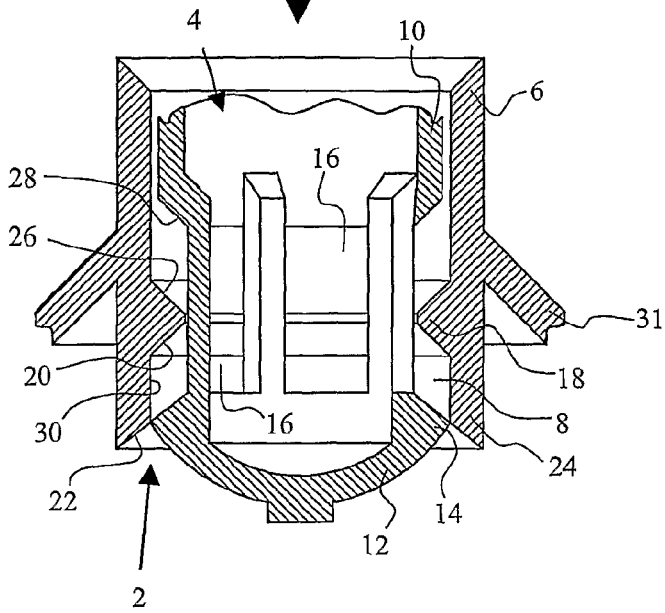

FIGS. 1*a*-1*c* show a first variant of a multifunctional sealing device 2 for a valve 4 for a drinking receptacle (not shown). The valve 4 is located in a short, non-moveable sleeve 6 defining a discharge conduit 8.

For valve-activation, the valve 4 comprises, among other things, a manoeuvre body in the form of a valve stem which, in this example of an embodiment, is formed as an axially moveable discharge pipe 10, the upstream end 12 of which is closed, and which is located in the sleeve 6.

For opening and closing of the discharge conduit, the valve 4 also comprises a sealing body in the form of an elastic and ring-shaped seal collar 14 extending outwardly towards the sleeve 6 and being located at the upstream end 12 of the discharge pipe 10. The seal collar 14 may be formed from a suitable plastics material, which is elastic by nature. The discharge pipe 10 is also provided with several pipe wall openings 16 located immediately downstream of the seal collar 14. Thereby, discharge of a fluid will take place through the pipe wall openings 16 and the discharge pipe 10 when the valve is in the open utility mode.

Along its inner periphery, the sleeve 6 is provided with a ring-shaped seal bulb 18 extending into the sleeve 6. The seal bulb 18 includes an upstream-directed storage seal seat 20 structured for sealing reception of said seal collar 14 when the valve 4 is in the storage mode, such as shown in FIG. 1*a*. This is possible because the seal collar 14 is located in a region upstream of the seal bulb 18.

Furthermore, the sleeve 6 is provided with an upstream-directed, ring-shaped end seat 22 also located upstream of the seal bulb 18 and being one of several utility seal seats in the sleeve 6. In this example of an embodiment, the end seat 22 is comprised of an upstream-directed bevel edge formed at an upstream end 24 of the sleeve 6. The end seat 22 is structured for sealing reception of the seal collar 14 when the valve 4 is in the closed utility mode, such as shown in FIG. 1*c*. Thus, the valve 4 is structured for opening of the discharge conduit 8 by virtue of upstream-directed movement of the seal collar 14 relative to the discharge direction of the valve, and away from the end seat 22, in which position the valve 4 is in the open utility mode, such as shown in FIG. 1*b*. In FIG. 1*b*, the discharge direction is indicated with downstream-directed arrows, whereas the movement direction of the seal collar 14 during valve opening is indicated with an upstream-directed arrow. Corresponding arrows are also shown in FIGS. 2*b* and 3*b*.

The seal bulb 18 also includes a downstream-directed, ring-shaped stop seat 26. This stop seat 26 is structured for motion-limiting contact with an external stop collar 28 formed around the discharge pipe 10 in a region located downstream of said pipe wall openings 16 and downstream of the seal bulb 18. FIG. 1*b* shows the stop collar 28 in contact with the stop seat 26 subsequent to upstream-directed and valve-opening axial movement of the discharge pipe 10.

The sleeve 6 also includes an internal and cylindrically shaped seal portion 30 located in a longitudinal portion between said end seat 22 and the seal bulb 18. In this example of an embodiment, the entire seal portion 30 is structured for slide-sealing against the seal collar 14. When in its radially expanded position, this seal collar 14 is arranged to have a marginally larger diameter than the diameter of the internal, cylindrical seal portion 30, such as shown in FIG. 1*c*. The cylindrical seal portion 30 may thus function both as continuous storage seal seats and utility seal seats, and the seal collar 14 will be somewhat compressed radially when positioned in the seal portion 30. Thus, all of the storage seal seats 20, 30 and utility seal seats 22, 30 are structured for sealing against the seal collar 14 during downstream-directed movement thereof.

Moreover, the sleeve 6 is connected to a surrounding support structure in the form of a wall portion or partition 31 provided with a discharge opening (not shown) and forming a part of, or being structured for connection to, said drinking receptacle. Among other things, such a partition is shown and described in the abovementioned NO 316506, which corresponds to WO 2002/098757 and EP 1.404.587; and in NO 321708, which corresponds to publication WO 2006/028378.

Reference is now made to FIGS. 2*a*-2*c* showing a second variant of said multifunctional sealing device 2. The only difference separating this second variant from the first variant according to FIGS. 1*a*-1*c*, concerns the internal seal portion of the sleeve 6, which is located in a longitudinal region between the end seat 22 and the seal bulb 18. The multifunctional sealing device 2 according to this second variant is provided with an internal seal portion 30' of a conical shape tapering in the upstream direction. Yet further, and when in its radially expanded position, the seal collar 14 is arranged to have a larger transverse dimension than the smallest transverse dimension of the conical seal portion 30', such as shown in FIG. 2*b* (open utility mode) and in FIG. 2*c* (closed utility mode). In the storage mode of the valve 4, the seal collar 14 is positioned sealingly against said storage seal seat 20 on the seal bulb 18, such as shown in FIG. 2*a*. In this position, and depending on its shape, the seal collar 14 may be radially unaltered or radially compressed. Thus, the seal collar 14 will be radially compressed at least in an upstream section of the conical seal portion 30', thereby functioning as continuous storage seal seats in the valve 4. In this second example of an embodiment, the other features of the valve 4 remain unchanged. This embodiment variant is well-suited should an underpressure exist or arise in the drinking receptacle when the valve 4 is in the storage mode.

Reference is now made to FIGS. 3*a*-3*c* showing a third variant of said multifunctional sealing device 2. The only difference separating this third variant from the preceding variants, concerns the shape of said internal seal portion in the sleeve 6. The multifunctional sealing device 2 according to this third variant is provided with an internal seal portion 30" of a conical shape tapering in the downstream direction. When in its radially expanded position, the seal collar 14 is also arranged to have a larger transverse dimension than the smallest transverse dimension of the conical seal portion 30", such as shown in FIG. 3*b* (open utility mode) and in FIG. 3*c* (closed utility mode). In the storage mode of the valve 4, the seal collar 14 is positioned sealingly against said storage seal seat 20 on the seal bulb 18, such as shown in FIG. 3*a*, in which position the seal collar 14 will be radially compressed. Thus, and depending on its shape, the seal collar 14 will be radially compressed at least in a downstream section of the conical seal portion 30", thereby functioning as continuous utility seal seats in the valve 4. In this third example of an embodiment, the other features of the valve 4 remain unchanged. This embodiment variant is well-suited should an overpressure exist in the drinking receptacle when the valve 4 is in the storage mode and in the closed utility mode.

Reference is now made to FIGS. 4*a*-4*c* showing one variant of a multifunctional sealing device 2' formed in accordance with said second aspect of the invention.

FIGS. 4*a*-4*c* show a multifunctional sealing device 2' for a valve 4' for a drinking receptacle (not shown). This valve 4' comprises, among other things, a manoeuvre body in the form of an axially moveable and flow-through pipe 32 defining a discharge conduit 34. The pipe 32 includes a ring-shaped, elastic seal portion 36 located at a downstream end of the pipe 32 so as to define a discharge portion 37 from the pipe 32. The simplest way to provide such an elastic seal portion 36 is to use a pipe 32 formed from a suitable plastics material, which is elastic by nature.

A non-moveable valve head 38 is located immediately downstream of the elastic and axially moveable seal portion 36 of the pipe 32. This valve head 38 includes, among other things, an external storage seal portion 40 located in a longitudinal region of the valve head 38 for sealing reception of the elastic seal portion 36 of the pipe 32, such as shown in FIG. 4*a*. Preferably, said storage seal portion 40 is of a cylindrical shape, as in this example of an embodiment, and functions as continuous storage seal seats in the valve 4'.

The valve head 38 also includes an external utility seal portion 42 located upstream of the storage seal portion 40 of the valve head 38. The external transverse dimensions of the utility seal portion 42 are smaller than the external trans-verse dimension of the storage seal portion 40. In this example of an embodiment, the utility seal portion 42 is of conical shape tapering in the upstream direction for progressively sealing reception of the elastic and axially moveable seal portion 36 of the pipe 32 when the valve 4' is in the closed utility mode, such as shown in FIG. 4*c*. Thus, the utility seal portion 42 functions as continuous utility seal seats in the valve 4'.

Yet further, the elastic seal portion 36 of the pipe 32 is structured in a manner allowing it to appear in a radially expanded position for sealing against the storage seal portion 40 of the valve head 38 when the valve 4' is in the storage mode, such as shown in FIG. 4*a*. In this example of an embodiment, an external, upstream-directed and ring-shaped stop seat 44, which is located immediately downstream of the storage seal portion 40, is formed in the valve head 38. The stop seat 44 prevents further downstream-directed axial movement of the elastic seal portion 36 of the pipe 32.

Thus, the valve 4' is structured for opening of said discharge conduit 34 by virtue of upstream-directed movement of the pipe 32 and its seal portion 36 relative to the discharge direction of the valve 4', and away from the valve head 38, in which position the valve 4' is in the open utility mode, such as shown in FIG. 4*b*. In this position, the seal portion 36 will also be radially relaxed relative to that of the valve 4' being in the storage mode. When the valve 4' is in the closed utility mode (cf. FIG. 4*c*), the elastic seal portion 36 may be radially relaxed or radially expanded, which depends on the size of a downstream-directed and valve-closing force pressing the axially movable pipe 32 against the valve head 38. Said force may, for example, be a spring force or resilience provided by an associated valve-activating mechanism. A potential overpressure in said drinking receptacle may also exert a valve-closing force on the axially moveable pipe 32.

In FIG. 4*b*, the discharge direction is indicated with downstream-directed arrows, whereas the movement direction of the axially moveable pipe 32 during valve opening is indicated with an upstream-directed arrow.

Yet further, the non-moveable valve head 38 is attached in a by-passable flow manner to a surrounding support structure 46 arranged for connection to said drinking receptacle. In this example of an embodiment, the support structure is in the form of an enclosure 46 which, via several stays 48 by-passable by flow, is attached to the valve head 38. A flow region defined by the axially movable pipe 32, the valve head 38, the stays 48 and the enclosure 46 thus define a discharge region 50 located downstream of the valve 4'. An enclosure and stay of this type is shown and described in the abovementioned patent application NO 20034132, which corresponds to WO 2005/026012.

The invention claimed is:

1. A valve device for a drinking receptacle, the valve device comprising:

a sleeve for discharging fluid from the drinking receptacle, the sleeve having an upstream end and a downstream end;

valve stem that is axially movable in the sleeve in both upstream and downstream directions;

wherein the valve stem comprises a closed upstream end having an elastic ring-shaped seal collar that extends outwardly towards the sleeve and faces in the downstream direction, wherein the valve stem further comprises at least one pipe wall opening located downstream of the seal collar, and wherein discharge of the fluid from the drinking receptacle occurs through the at least one pipe wall opening and into the valve stem when the valve stem is located in an open utility mode position;

a ring-shaped seal bulb that extends into the sleeve and is located between the upstream end and the downstream end;

an upstream-directed storage seal seat on the ring-shaped seal bulb, wherein the upstream-directed storage seal seat seals with the ring-shaped seal collar so as to prevent discharge of the fluid from the drinking receptacle when the valve stem is located in a closed storage mode position; and an upstream-directed ring-shaped end seat that is located upstream of the seal bulb and that seals with the elastic ring-shaped seal collar and prevents discharge of the fluid from the drinking receptacle when the valve stem is located in a closed utility mode position;

wherein the ring-shaped seal bulb is located downstream of both the upstream-directed ring-shaped end seat and the ring-shaped seal collar; and wherein the upstream-directed storage seal seat does not seal with the ring-shaped seal collar when the valve stem is located in the closed, utility mode position.

2. The valve device according to claim 1, further comprising a cylindrically-shaped seal portion that extends along, the sleeve between the ring-shaped seal bulb and ring-shaped end seat such that the ring-shaped seal bulb and ring-shaped end seat are spaced apart from each other and the cylindrically-shaped seal portion is disposed therebetween.

3. The valve device according to claim 2, wherein the ring-shaped seal bulb extends radially inwardly from the cylindrically-shaped seal portion at least when the valve stem is located in the open utility mode position.

4. The valve device according to claim 3, wherein the upstream-directed storage seal seat is planar and radially inwardly extends at an obtuse angle with respect to the cylindrically-shaped seal portion.

5. The valve device according, to claim 1, wherein the ring-shaped seal bulb comprises a downstream-directed, ring-shaped stop seat that engages with an external stop collar formed on the valve stem at a location downstream of the pipe wall openings and downstream of the ring-shaped seal bulb when the valve stem is moved into the open utility mode position.

6. The valve device according, to claim 5, wherein the downstream-directed storage seal seat is planar and radially inwardly extends at an obtuse angle with respect to the cylindrically-shaped seal portion.

7. The valve device according to claim 6, wherein the external stop collar is planar and extends at an obtuse angle with respect to the valve stem.

8. The valve device according to claim 1, wherein the ring-shaped seal bulb has a triangular cross-section, wherein the upstream-directed storage seal seat is firmed by one side of the triangular cross-section and wherein the downstream-directed, ring-shaped stop seat is formed by another side of the triangular cross-section.

9. The valve device according to claim 1, wherein the elastic ring-shaped seal collar slide seals against the cylindrically-shaped seal portion when the valve stem is moved between the closed storage mode position and the closed utility mode position.

10. The valve device according to claim 1, wherein the elastic ring-shaped seal collar has a larger diameter than the cylindrically-shaped seal portion such that the elastic ring-shaped seal collar is radially compressed when positioned in the cylindrically-shaped seal portion.

11. The valve device according to claim 1, wherein the upstream-directed ring-shaped end seat comprises a beveled edge of the upstream end of the sleeve.

* * * * *